US006691712B2

(12) United States Patent
Chu et al.

(10) Patent No.: US 6,691,712 B2
(45) **Date of Patent: *Feb. 17, 2004**

(54) HAIR DYE APPLICATOR

(75) Inventors: Lorrayne Yen Chu, West Newton, MA (US); John De Piano, Burlington, MA (US); May Mu, Carlisle, MA (US); Philip H. Parda, Killingworth, CT (US)

(73) Assignee: New Basics, Inc., Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/102,521

(22) Filed: Mar. 19, 2002

(65) Prior Publication Data

US 2002/0148480 A1 Oct. 17, 2002

Related U.S. Application Data

(63) Continuation of application No. 09/712,799, filed on Nov. 14, 2000, now Pat. No. 6,357,449, which is a continuation-in-part of application No. PCT/US00/04694, filed on Feb. 24, 2000, which is a continuation-in-part of application No. 09/259,506, filed on Feb. 26, 1999, now Pat. No. 6,145,513.

(51) Int. Cl.[7] ..... A45D 24/22; A46B 11/00

(52) U.S. Cl. ..... 132/112; 132/114; 132/115; 401/268

(58) Field of Search ..... 132/112, 114, 132/115, 116, 108; 401/10, 35, 192, 199, 268

(56) References Cited

U.S. PATENT DOCUMENTS

| | | | | |
|---|---|---|---|---|
| 3,570,499 | A | 3/1971 | Ruta | 132/9 |
| 3,861,407 | A | 1/1975 | Gabriele | 132/108 |
| 3,960,160 | A | 6/1976 | Hogan | 132/112 |
| 3,961,635 | A | 6/1976 | Miya | 132/11 R |
| 4,211,247 | A | 7/1980 | Morganroth | 132/88.7 |
| 4,224,954 | A | 9/1980 | Stahl | 132/7 |
| 4,294,270 | A | 10/1981 | Cochran | 132/112 |
| 4,364,515 | A | 12/1982 | Prussin | 239/8 |
| 4,385,638 | A | 5/1983 | Hasegawa | 132/88.5 |

(List continued on next page.)

FOREIGN PATENT DOCUMENTS

| | | |
|---|---|---|
| DE | 30 48 827 A1 | 7/1982 |
| EP | 0 038 024 B1 | 10/1981 |
| EP | 0 043 519 A1 | 1/1982 |
| JP | 9-23922 | 1/1997 |
| TW | 321850 | 12/1997 |
| WO | WO 98/46202 | 10/1998 |

*Primary Examiner*—John J. Wilson
*Assistant Examiner*—Robyn Kieu Doan
(74) *Attorney, Agent, or Firm*—Hamilton, Brook, Smith & Reynolds, P.C.

(57) ABSTRACT

A dispensing device for use as a hair dye applicator is provided having a manifold having a first end configured to receive liquid dye and an inside surface and an outside surface. The manifold has a conduit communicating with the inside surface and the first end which provides fluid communication between the first end and at least one orifice extending from the inside surface to the outside surface. The manifold further includes a first lip and a second lip on the outside surface with the first lip surrounding the orifice and the second lip surrounding the first lip. The manifold further includes a flexible fluid dispensing member having an inside surface and an outside surface and a plurality of apertures passing from the inside surface to the outside surface that presents the dye to the hair, the inside surface of the member contacting the outside surface of the manifold including the first and second lips such that a resilient seal is formed until the dye is forced through the orifices when the member allows the dye to pass over the first lip and through the plurality of apertures.

1 Claim, 21 Drawing Sheets

U.S. PATENT DOCUMENTS

| | | | | |
|---|---|---|---|---|
| 4,597,683 | A | 7/1986 | Wittersheim et al. | 401/4 |
| 4,658,840 | A | 4/1987 | McCosker | 132/7 |
| 4,665,933 | A | 5/1987 | Zinger et al. | 132/9 |
| 4,687,663 | A | 8/1987 | Schaeffer | 424/52 |
| 4,747,420 | A | 5/1988 | Alaimo | 132/112 |
| 4,881,558 | A | 11/1989 | Hollenberg et al. | 132/112 |
| 4,902,154 | A | 2/1990 | Valenza | 401/132 |
| 4,922,859 | A | 5/1990 | Durell et al. | 119/83 |
| 4,942,893 | A | 7/1990 | Trottier | 132/270 |
| 4,958,647 | A | 9/1990 | Busch et al. | 132/119.1 |
| 4,961,439 | A | 10/1990 | Hartmann | 132/212 |
| 4,964,539 | A | 10/1990 | Mueller | 222/94 |
| 5,000,199 | A | 3/1991 | Kuranski et al. | 132/112 |
| 5,002,075 | A | 3/1991 | Kellett et al. | 132/108 |
| 5,006,004 | A | 4/1991 | Dirksing et al. | 401/261 |
| 5,020,694 | A | 6/1991 | Pettengill | 222/137 |
| 5,024,243 | A | 6/1991 | Snyder | 132/116 |
| 5,053,218 | A | 10/1991 | Shernov | 424/47 |
| 5,056,480 | A | 10/1991 | Murray | 132/114 |
| 5,056,538 | A | 10/1991 | Matula | 132/208 |
| 5,059,050 | A | 10/1991 | Guglielmo | 401/171 |
| 5,119,838 | A | 6/1992 | Nakazima | 132/108 |
| 5,146,936 | A | 9/1992 | Ng | 132/208 |
| 5,146,937 | A | 9/1992 | Lefebvre | 132/208 |
| 5,152,305 | A | 10/1992 | Niv | 132/112 |
| 5,188,132 | A | 2/1993 | Barkus | 132/219 |
| 5,215,106 | A | 6/1993 | Choi | 132/109 |
| 5,289,833 | A | 3/1994 | McDonald | 132/112 |
| 5,289,835 | A | 3/1994 | Harlan et al. | 132/313 |
| 5,291,905 | A | 3/1994 | Busch et al. | 132/116 |
| 5,335,679 | A | 8/1994 | Baxter | 132/270 |
| 5,339,839 | A | 8/1994 | Forcelledo et al. | 132/114 |
| 5,343,880 | A | 9/1994 | McKay | 132/116 |
| 5,433,225 | A | 7/1995 | Liggett et al. | 132/208 |
| 5,469,873 | A | 11/1995 | Guth | 132/270 |
| 5,472,456 | A | 12/1995 | Larsky et al. | 8/405 |
| 5,483,979 | A | 1/1996 | Bertieri | 132/114 |
| 5,499,637 | A | 3/1996 | Foti | 132/200 |
| 5,533,537 | A | 7/1996 | Mourad | 132/148 |
| 5,551,454 | A | 9/1996 | Goncalves | 132/208 |
| 5,555,899 | A | 9/1996 | Foreman | 132/114 |
| 5,562,111 | A | 10/1996 | Torres | 132/270 |
| 5,584,309 | A | 12/1996 | De Beneditis et al. | 132/208 |
| 5,588,449 | A | 12/1996 | Falcon | 132/208 |
| 5,655,551 | A | 8/1997 | Knight | 132/200 |
| 5,664,590 | A | 9/1997 | Plateroti et al. | 132/270 |
| 5,676,480 | A | 10/1997 | Tosto | 401/10 |
| 5,709,910 | A | 1/1998 | Argyle et al. | 427/434.2 |
| 5,778,902 | A | 7/1998 | Nagy | 132/200 |
| 5,845,653 | A | 12/1998 | Abercrombie | 132/208 |
| 5,848,598 | A | 12/1998 | Walz et al. | 132/112 |
| 6,145,513 | A * | 11/2000 | Chu et al. | 132/112 |
| 6,302,607 | B1 | 10/2001 | Burrowes et al. | 401/18 |

* cited by examiner

FIG. 28
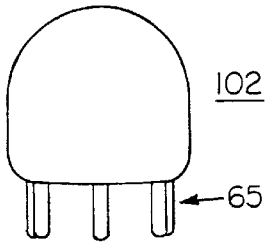
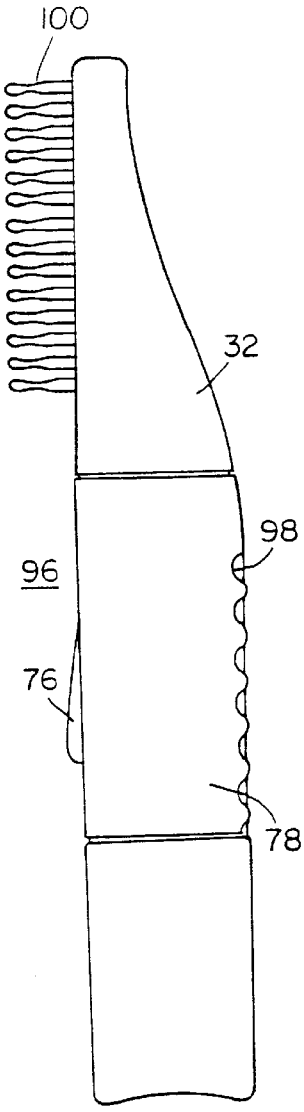
FIG. 24
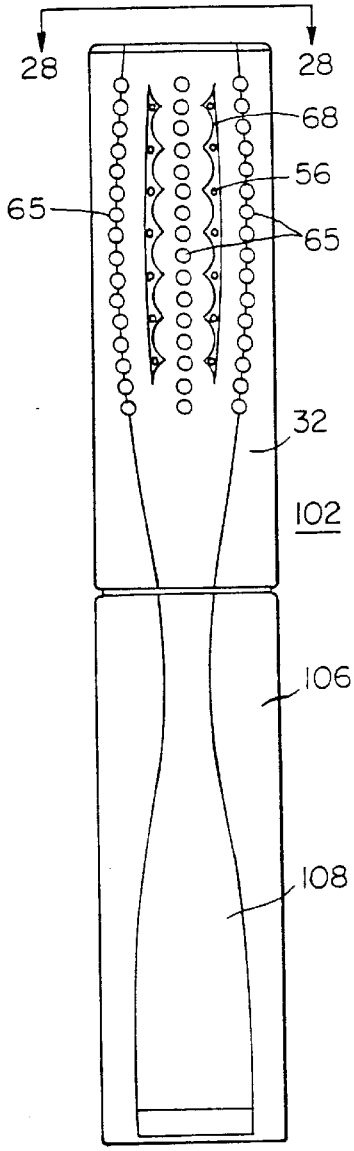
FIG. 26
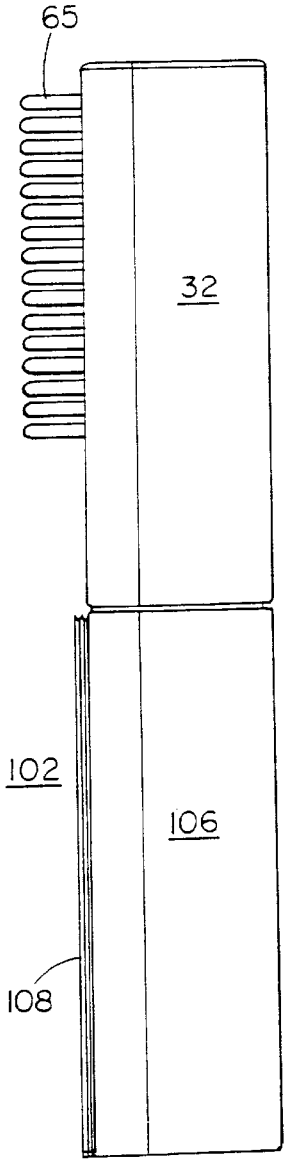
FIG. 27

HAIR DYE APPLICATOR

RELATED APPLICATIONS

This application is a continuation of U.S. patent application Ser. No. 09/712,799, filed on Nov. 14, 2000, now U.S. Pat. No. 6,357,449, which is a continuation-in-part of International Application No. PCT/US00/04694, which designated the U.S. and was filed Feb. 24, 2000, published in English on Aug. 31, 2000, which is a continuation-in-part of U.S. patent application Ser. No. 09/259,506, filed Feb. 26, 1999, now U.S. Pat. No. 6,145,513. The entire teachings of the above applications are incorporated herein by reference.

BACKGROUND OF THE INVENTION

Conventional hair dye applicator devices that utilize a compressible bottle containing liquid dye are well known in the art. However, such devices typically do not provide means for controlling application of the dye to the user's hair in an acceptable manner. Furthermore, these prior art devices have no controllable means to minimize dye from coming into contact with the user's scalp which is undesirable and may irritate the user's skin.

SUMMARY OF THE INVENTION

The invention relates to a hair dye applicator that is used by an operator to uniformly and controllably present a liquid dye to the operator's hair or to the hair of another person. The hair dye applicator includes a compressible air container with a fluid container designed to contain the liquid dye positioned within the air container. A manifold with a first end in fluid communication with the liquid dye is removably attached to the air container. The manifold includes an inside surface opening onto the first end, an outside surface, and a conduit communicating with the inside surface and the first end which provides fluid communication between the first end and at least one orifice extending from the inside surface to the outside surface. The manifold further includes a first lip and a second lip on the outside surface, with the first lip surrounding the orifice and the second lip surrounding the first lip.

The hair dye applicator further includes a flexible fluid dispensing member having an inside surface, an outside surface, and a plurality of apertures passing from the inside surface to the outside surface that presents the dye to the hair. The inside surface of the member contacts the outside surface of the manifold including the first and second lips such that a resilient seal is formed until the dye is forced through the orifices when the member allows the dye to pass over the first lip and through the plurality of apertures. This allows the applicator to be positioned in any orientation during the dyeing process (e.g., upside-down) while maintaining a continuous flow of dye from the fluid container to the hair being dyed.

The dispensing member can further include dye presentation grooves positioned along a longitudinal axis and on the outside surface of the dispensing member which help present the dye from the apertures to the hair.

The fluid container can include an integral interface member that forms a seal between the air container and the manifold. The air container can further include a one-way valve that allows air into the air container, such that the air container can be successively squeezed so that the dye is continuously and controllably provided to the dye presentation grooves.

According to another aspect of one embodiment of the present invention, the dispensing member includes a plurality of bristles extending therefrom to comb the hair to allow the dye to transfer onto the hair. In one embodiment, a first row of bristles having a first height is positioned along a longitudinal axis of the dispensing member, and at least a second row of bristles having a second height is also positioned along the longitudinal axis, the first and second rows being offset relative to each other along a line perpendicular to the longitudinal axis. The bristles also maintain the scalp a predetermined distance away from the dye presentation grooves such that a minimal amount of dye is presented to the scalp.

In an embodiment of the present invention, the dispensing member includes a keying member positioned along a longitudinal axis thereof and the manifold has a groove along its longitudinal axis that accepts the keying member such that the dispensing member is positioned on the manifold in a predetermined orientation.

Additionally, the present invention provides a method of dyeing hair comprising the steps of providing a collapsible container carrying dye within a flexible container and a brush having a plurality of teeth for combing hair, pumping the flexible container, thereby compressing the collapsible container with air pressure and forcing the dye out of the collapsible container which opens a valve with the force of the dye to move the dye into at least one channel in proximity to the teeth. The method further includes the steps of moving the teeth of the brush through the hair to transfer dye to the hair, releasing the flexible container therein allowing air to enter the container through a second valve, and repeating the process from pumping the flexible container until the dyeing is complete.

According to a further aspect of the present invention, a hair dyeing apparatus is provided having an enclosure which includes an open end and an aperture. A fluid container that contains a liquid dye is positioned within the open end and a manifold is connected to the open end of the enclosure in fluid communication with the liquid dye. A brush cover is removably positioned over the manifold such that the brush cover is in fluid communication with the fluid container during the dyeing process. A resilient bellows which includes an orifice is positioned to be in communication with the aperture such that when the bellows is compressed with the operator's finger covering the orifice, the liquid dye is forced through the brush cover to the hair to be dyed.

In accordance with another embodiment, a hair dye applicator device is provided which includes a collapsible fluid container for containing a liquid dye. The fluid container has an open end for allowing egress of the liquid dye. A one-way valve is provided which communicates with the open end of the fluid container for allowing egress of the liquid dye. A compressible air container encases the fluid container and includes an aperture there through. As the air container is compressed with the user's finger covering the aperture, the fluid container collapses to force the liquid dye out of the fluid container.

Preferably, the air container is formed from a resilient material and fills with air through the aperture as the user releases compressive force on the air container with the finger not covering the aperture. The one-way valve substantially prevents the liquid dye from reentering the fluid container.

A manifold is further provided in communication with the one-way valve and a brush cover is removably positioned over the manifold. The brush cover is in fluid communication with the liquid dye during application of the liquid dye to the hair to be dyed. The manifold includes an internal conduit that receives the liquid dye at a first end of the manifold and further includes a plurality of orifices in fluid communication with the conduit that extend to an outside surface of the manifold. The orifices in one embodiment increase in diameter as a function of the distance from the first end of the manifold.

A brush cover is further provided having an inside surface and an outside surface and a plurality of apertures extending from the inside surface to the outside surface. The apertures are in fluid communication with the orifices of the manifold during the dyeing process. In one embodiment, the brush cover includes a groove along the longitudinal axis of the cover in communication with at least one of the plurality of apertures. An alignment mechanism is provided for ensuring the brush cover is positioned over the manifold in a predetermined direction.

In one embodiment, the manifold is removably attachable to the air container and the device includes an alignment mechanism to align the manifold on the air container in a predetermined orientation. Preferably, the alignment mechanism includes a first protruding member extending from the manifold and a second protruding member extending from the air container. The first and second protruding members contact to prevent rotation of the manifold onto the air container upon reaching the predetermined orientation.

A jacket can optionally be provided which encases at least a portion of the air container. The jacket has an aperture there through which communicates with the orifice of the air container. In one embodiment, a bellows is provided on the jacket and the aperture passes through the bellows.

In one embodiment, the brush and the manifold is formed as an integral single brush/manifold unit. A plurality of apertures extend directly from an internal conduit to the outside surface in proximity to teeth. The brush/manifold unit can have a coating.

Thus, the present invention provides a hair dye applicator having the immediate advantages of efficiently and conveniently dispensing a liquid dye to the user's hair in a controlled manner due to a unique valving system. Further, the hair dye applicator of the present invention minimizes the amount of dye contacting the user's scalp during the dyeing process.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIGS. 22–25 are front, back, side, and end views, respectively, of another preferred embodiment of a hair dye applicator in accordance with the present invention;

FIGS. 26–28 are front, side, and end views, respectively, of yet another embodiment of a hair dye applicator in accordance with the present invention;

DETAILED DESCRIPTION OF THE INVENTION

Figure 1:
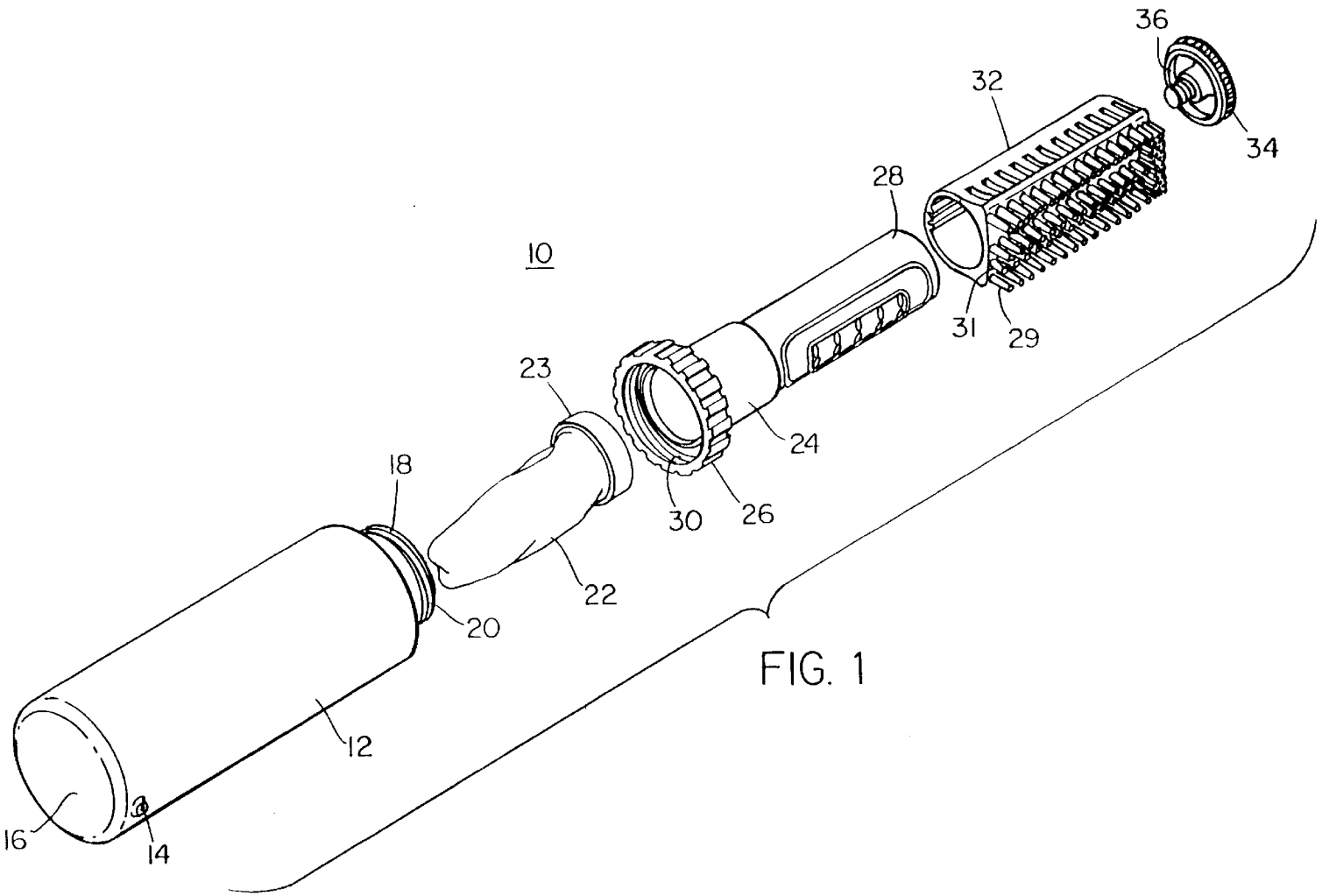
FIG. 1 is an exploded, isometric view of a preferred hair dye applicator in accordance with the present invention.

Turning to the figures, the present invention is described below in detail. More particularly, FIG. 1 illustrates an exploded isometric view of a embodiment of a hair dye applicator, generally designated as reference number 10. Applicator 10 comprises compressible air container 12 having an open end 18 and a closed end 16. Air container 12 further includes a one-way valve 14 for allowing air into container 12. The operation of valve 14 will be discussed below. A collapsible fluid container 22 is removably positioned within air container 12 and is designed to contain a liquid dye.

Applicator 10 further comprises fluid manifold 24 having first end 26 and second end 28. First end 26 includes an internally threaded portion 30 that threadedly engages externally threaded portion 20 at open end 18 of container 12 to secure fluid manifold 24 to open end 18 of container 12. It is understood that other suitable joining mechanisms can be used to secure manifold 24 to container 12. Fluid container 22 is provided with an interface member 23, which can be integrally molded with the container, bonded, or otherwise secured by another method. Interface member 23 advantageously forms part of the seal between air container 12 and manifold 24. It has been found that the size of fluid container 22 can be selected such that the operation of the applicator 10, as will be explained below, is optimized. In one embodiment, fluid container 22 is formed from a polymer such as a blow-molded polymer.

Figure 2:
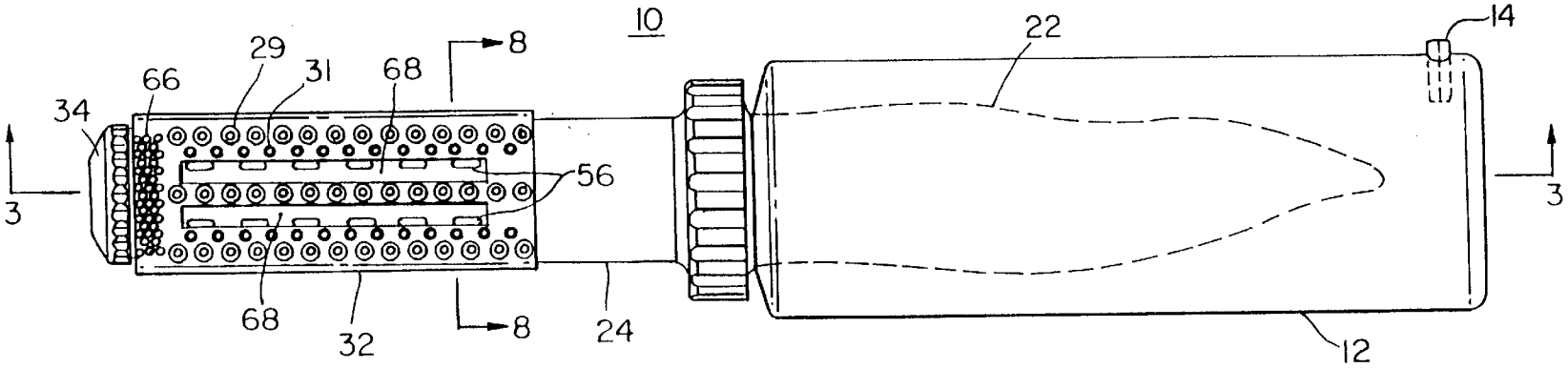
FIG. 2 is a plan view of the assembled hair dye applicator of FIG. 1.
Figure 3:
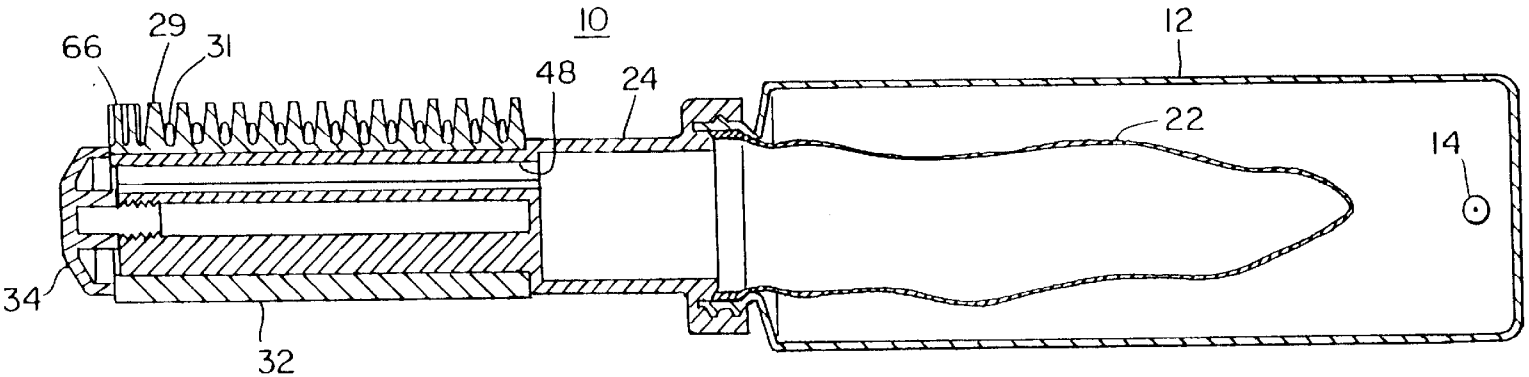
FIG. 3 is a cross section taken along line 3—3 of the hair dye applicator of FIG. 2.

Applicator 10 additionally includes a flexible fluid dispensing member, also referred to as a brush cover 32, which removably slides over manifold 24. Brush cover 32 is in fluid communication with fluid container 22 during the dyeing process and includes a plurality of bristles 29 and 31 that are used by the operator to comb the hair being dyed such that the dye is uniformly presented to the hair. A removable cap 34 having an externally threaded portion 36 threadedly engages internally threaded portion 38 of manifold 24 (see FIG. 4) to secure cover 32 onto manifold 24. There are many suitable ways to removably secure cover 32 onto manifold 24, as easily understood by one skilled in the art. FIGS. 2 and 3 illustrate the assembled applicator 10 with the fluid container 22 positioned inside air container 12.

Figure 4:
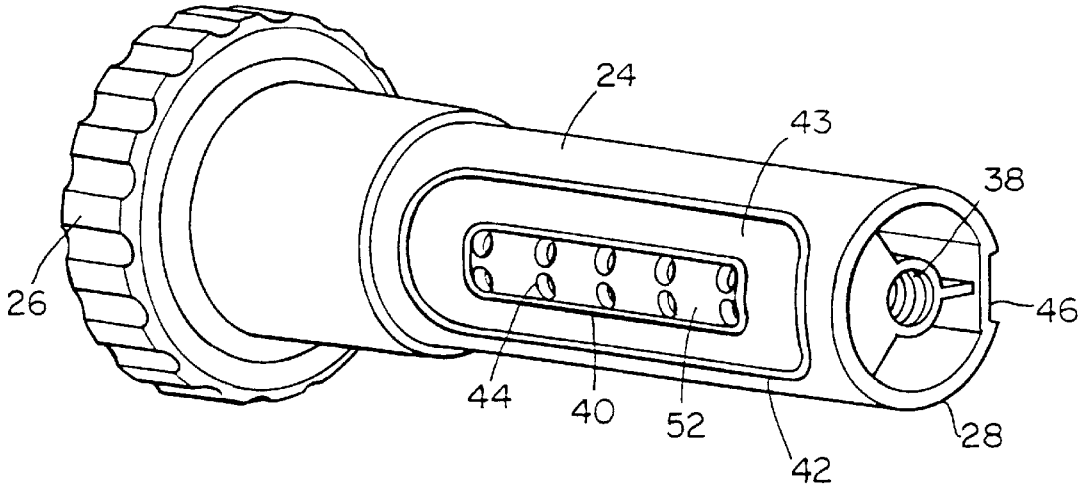
FIGS. 4 and 5 are isometric views of the fluid manifold shown in FIG. 1.
Figure 5:
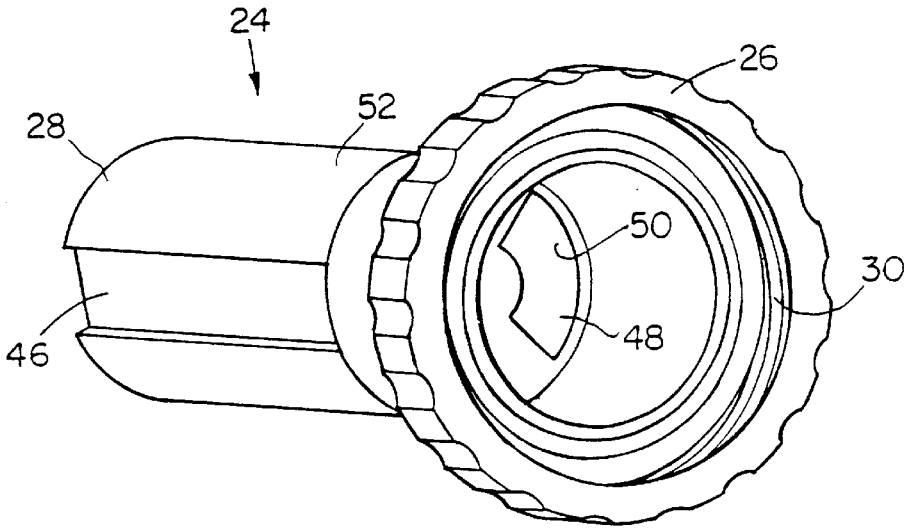
Figure 8:
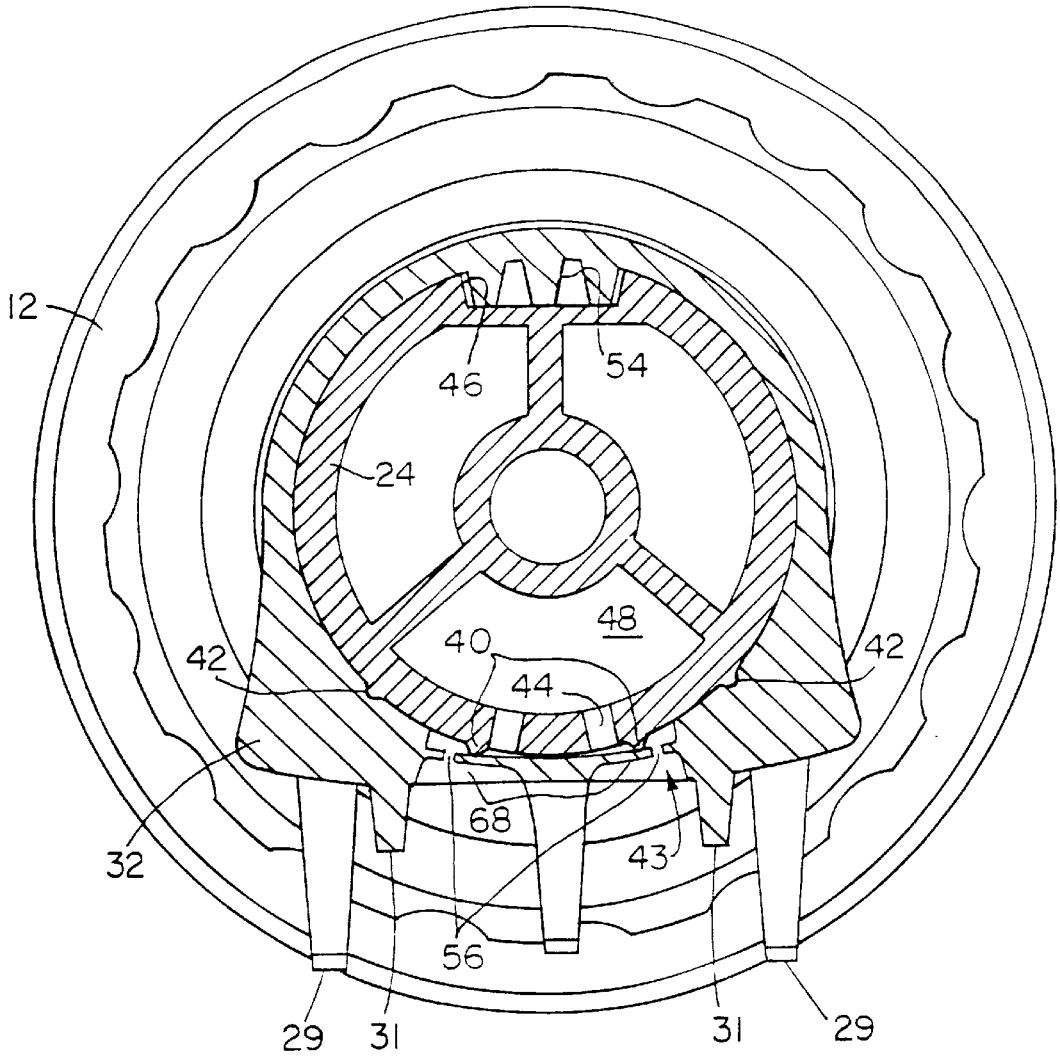
FIG. 8 is a cross section taken along line 8—8 of FIG. 3.

FIGS. 4 and 5 are perspective views of manifold 24. As shown, manifold 24 includes a plurality of orifices 44 which extend from an outside surface 52 to an inside surface 50 of the manifold. An internal conduit or flow cavity 48 fluidly connects first end 26 of fluid manifold 24 to orifices 44. As described above, first end 26 is in fluid communication with fluid container 22 that contains the liquid dye. Manifold 24 further includes a first manifold valve lip 40 surrounding orifices 44. Manifold 24 further includes a second manifold valve lip 42 which surrounds first valve lip 40 to form annular channel 43. Second valve lip 42 is raised slightly higher than first valve lip to form a secure seal between lip 42 and the interior surface 58 of cover 32 as seen in FIG. 8. Manifold 24 further includes groove 46 positioned along a longitudinal axis thereof, as best seen in FIG. 5, to position the brush cover 32 thereon in a predetermined orientation. Manifold 24 can be formed from many materials. Preferably, it is molded from a thermoplastic such as acrylonitrile-butadiene-styrene copolymer (ABS).

Figure 6:
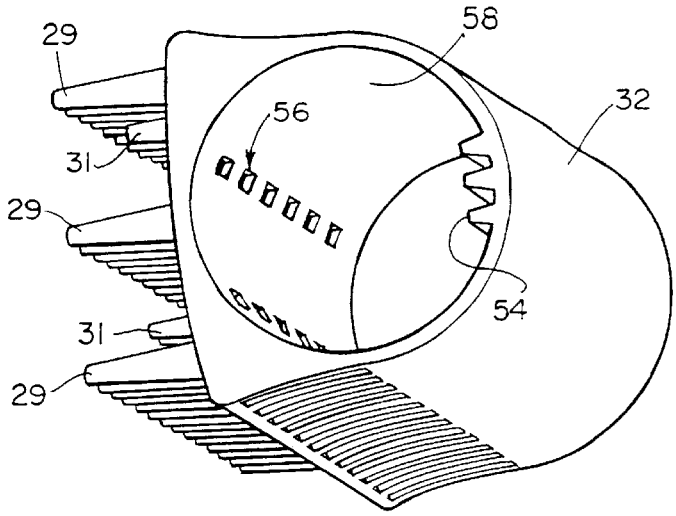
FIGS. 6 and 7 are isometric views of the brush cover shown in FIG. 1.
Figure 7:
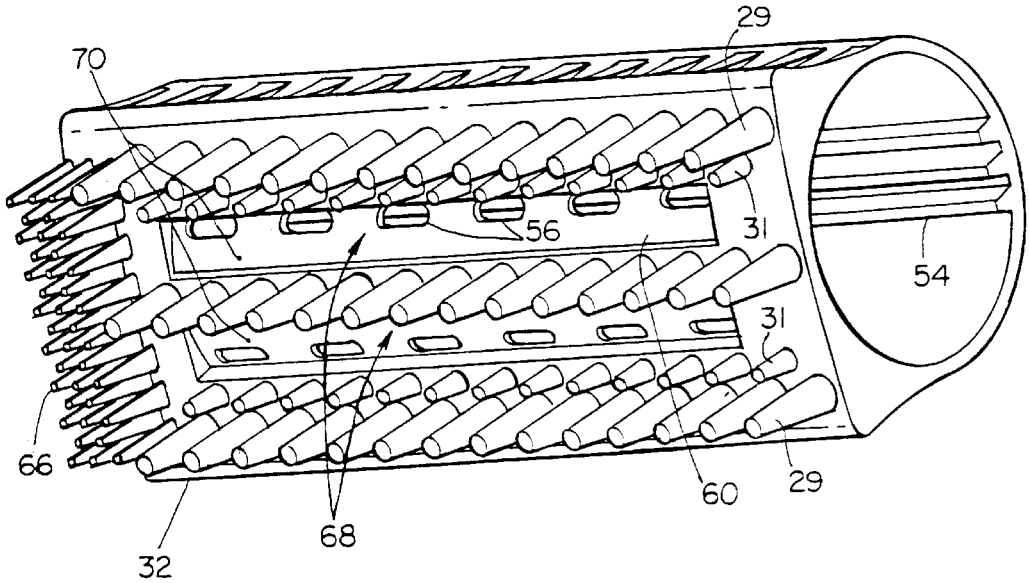

FIGS. 6 and 7 further illustrate details of brush cover 32. More particularly, cover 32 includes keying member 54 which mates with groove 46 (seen in FIG. 5) when cover 32 is slid over manifold 24 in a predetermined orientation. Preferably, keying member 54 is integral with cover 32 although it could be installed separately. Cover 32 includes a plurality of apertures 56 extending from an inside surface 58 to an outside surface 60 of the cover to allow the liquid dye to be presented to the hair. When cover 32 is properly positioned on manifold 24, apertures 56 are positioned between first valve lip 40 and second valve lip 42 (i.e., communication with the annular channel 43 shown in FIG. 4), with the inside surface 58 of cover 32 fitting snugly over the first and second valve lips.

Cover 32 further includes a flexible portion 70, which may be formed by a thinned out wall section formed by a groove or the like, proximal to apertures 56, as best seen in FIG. 7. This allows cover 32 to flex allowing the dye to travel over first valve lip 40 and through apertures 56 upon compression of air container 12 which forces the liquid dye through orifices 44 of the manifold 24, as best seen in FIG. 8. The one-way valve 14 in the air container 12 allows the operator to continue squeezing container 12 to further compress fluid container 22, thus forcing the dye through conduit 48 and orifices 44 and over first valve lip 40. Because second valve lip 42 is raised more than first valve lip 40, the liquid dye is prevented from flowing around the entire outside surface 52 of the manifold 24 and thus contained in annular chamber 43. This can be seen more clearly in FIG. 8. When the user discontinues compressing air container 12, i.e., in between squeezing motions, the inside surface 58 of cover 32 forms a temporary seal with first valve lip 40 to prevent the liquid dye and ambient air from entering the manifold 24 and hence fluid container 22. In this manner, a valving system is provided that uses a resilient seal that allows the dye to flow one way from orifices 44 to apertures 56 in a controlled manner such that the dye can be uniformly applied to the hair. This valving system allows the applicator 10 to be used in any orientation (e.g., upside-down) while maintaining a continuous flow of dye from fluid container 22 to the hair being dyed.

Cover 32 further includes a pair of dye presentation grooves 68 on the outside surface 60 thereof (best seen in FIG. 7) in communication with apertures 56. Grooves 68 are preferably positioned along a longitudinal axis of cover 32 and allow the dye exiting apertures 56 to flow along the grooves to uniformly present the dye to the hair.

Cover 32 also includes bristles 29 and 31, also referred to as teeth, which are used by the operator to comb the hair during the dyeing process. Preferably, there are three rows of bristles 29 of a first height positioned along the longitudinal axis of the cover 32 which serve to comb and position the hair such that it uniformly contacts the dye in the dye presentation grooves 68. Also, a row of bristles 31 of a second height is provided parallel to bristles 29 but positioned offset relative to each other along a line perpendicular to the longitudinal axis, as seen more clearly in FIG. 3. This allows the hair to be further separated in a cascaded fashion, such that the dye can be more evenly applied to the hair. Also, it has been found that different height rows of bristles best comb and separate different textures of hair, such that dye can be evenly applied.

Cover 32 may further include a plurality of fine, densely positioned bristles 66 positioned at the adjacent end of cap 34 to allow accurate placement of dye, e.g., when dyeing sideburns. Cover 32 can be fabricated from a variety of materials. Preferably, cover 32 is injection molded from a flexible material such as a thermoplastic rubber (e.g., Santoprene® brand rubber marketed by Advanced Elastomer Systems, L. P.) with bristles 29 and 31 being integrally formed thereon. The rubber has a preferable hardness in the range of about 55–75 Shore A units, and most preferably in the range of about 60–65 Shore A units. The rubber has a preferable ultimate tensile strength in the range of about 400–500 psi, and most preferably in the range of about 460–480 psi. This allows cover 32 to be sufficiently durable to have an extended life span under rigorous use, yet be elastomeric such that the flexible portion 70 can be formed therein and bristles 29 and 31 do not scratch the user's scalp. Also, it is preferable that the rubber be chemically resistant to the liquid dye such that no significant deterioration results with extended use and the dye will not significantly stain cover 32 during normal use resulting in an aesthetically displeasing applicator 10.

The operation of applicator 10 will now be described. The operator fills the fluid container 22 with liquid dye and positions the container 22 within air container 12. The fluid manifold 24 is screwed onto the open end 18 of container 12 and the cover 32 is slid over the manifold and secured thereto by cap 34. Now, the operator gently squeezes air container 12 such that compressed air collapses fluid container 22 to force the dye through orifices 44, annular chamber 43, apertures 56, and into dye presentation grooves 68. The operator combs the hair with bristles 29 and 31 to uniformly and controllably apply the dye from the grooves 68 to the hair. The staggered bristles 29 and 31 uniformly present the hair to the grooves 68 such that the dye is evenly applied thereon. The operator repeatedly squeezes air container 12 as needed to refill grooves 68. In a preferred method, the operator is dyeing his or her own hair. However, the operator can use the applicator 10 to dye another person's hair as well.

Figure 11:
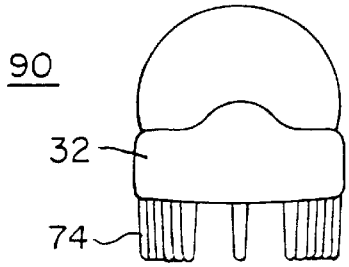
FIG. 11 is an end view taken along line 11—11 of FIG. 10.
Figure 10:
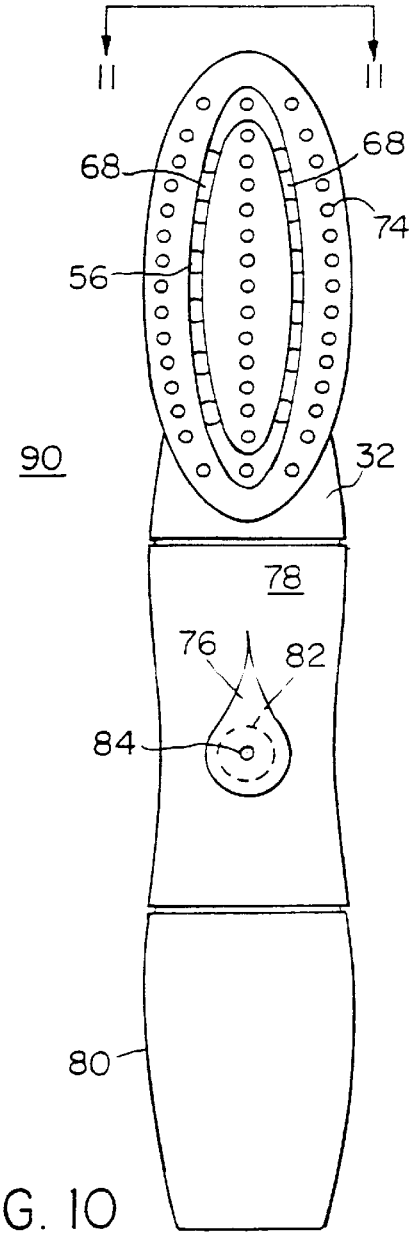
FIG. 10 is a front view of the hair dye applicator of FIG. 9.
Figure 9:
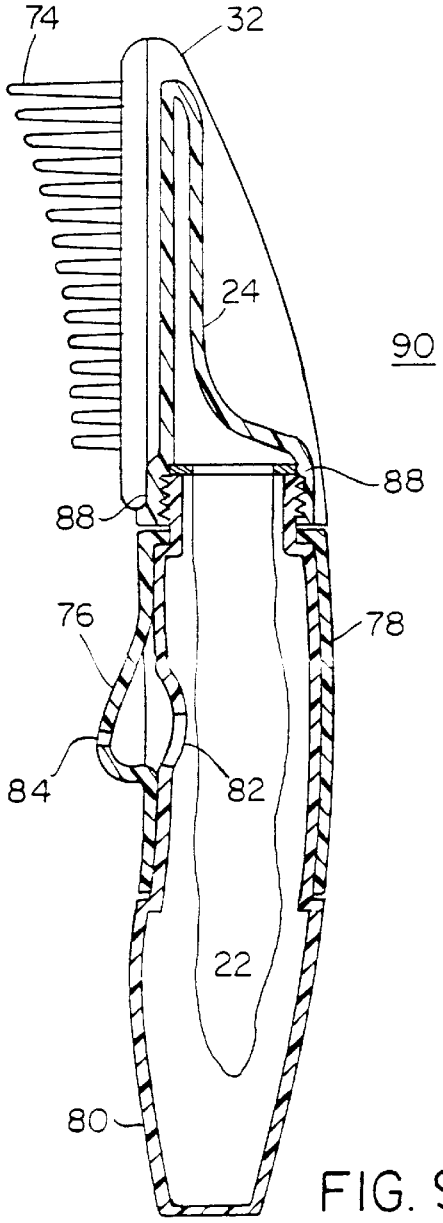
FIG. 9 is a cut-away cross-sectional view of another embodiment of a hair dye applicator according to this invention.

FIGS. 9–11 illustrate another preferred embodiment of a hair dye applicator 90 in accordance with the present invention wherein like reference numbers refer to the same or similar elements. As particularly illustrated in FIG. 9, the applicator 90 includes an air container or enclosure 80 that houses collapsible fluid container 22. As before, fluid manifold 24 is connected to the open end of the air container 80 and brush cover 32 is removably positioned on the outside surface of the fluid manifold. In this embodiment, brush cover 32 is removably attached to fluid manifold 24 by interlocking an annular ridge 88 with a lip of the fluid manifold. In this manner, the brush cover 32 can be positioned on and removed from fluid manifold 24 quickly for cleaning, storing, etc. It is readily understood that other joining mechanisms to detachably secure brush cover 32 to fluid manifold 24 can be used in accordance with the present invention. Brush cover 32 includes teeth or bristles 74 extending therefrom, which may be curved as shown, i.e., relative to a longitudinal axis of the brush cover. This ergonomic design of the applicator 90 has been found to be exceptionally convenient to use during the dyeing process. Dye presentation grooves 68 in this embodiment are curved as shown.

Also illustrated in FIGS. 9 and 10 is a pump mechanism for controllably compressing collapsible fluid container 22. More specifically, a resilient bellows 76 is provided in communication with an aperture 82 in container 80 to force air into the air container 80 to compress collapsible fluid container 22. As before, compression of fluid container 22 forces the dye over the first lip 40, through annular channel 43 and apertures 56 and thus to the hair to be dyed. Bellows 76 includes an orifice 84 that is blocked/open when the operator compresses/releases the bellows. Thus, when the operator compresses bellows 76, the air within the bellows is forced inside container 80. When bellows 76 is released, ambient air passes through orifice 84 and refills the bellows as the bellows resiliently returns to its original position.

In operation, the operator may need to compress bellows 76 multiple times during the dyeing process such that the dye is controllably supplied to the dye presentation grooves 68 in brush cover 32. Bellows 76 can be integrally molded to a jacket 78 which surrounds the outside surface of the container 80. Bellows 76 and jacket 78 can be formed from a variety of materials, but it is preferable that the jacket 78 have a rubbery grip such that the applicator 90 will not easily slip out of the operator's hand and the bellows 76 resiliently responds to its original position after deformation. Thus, bellows 76 and jacket 78 are formed from a thermoplastic rubber such as sold under trade name Santoprene®, preferably having a hardness in the range of about 30–45, and most preferably in the range of about 35–40 Shore A units.

The operation of applicator 90 will now be described. The operator fills the fluid container 22 with liquid dye and positions the container 22 within air container 12. At this point, jacket 78 is already positioned on the outside of air container 12 with bellows 76 communicating with fluid container 22 via aperture 82. The fluid manifold 24 is screwed onto the open end 18 of container 12 and cover 32 is slid over the manifold until ridge 88 removably attaches onto the lip of the manifold. Now, the operator compresses the bellows 76 while blocking orifice 84 to force the air within bellows into air container 12 to compress the fluid container 22. This forces the dye through orifices 44, annular chamber 43, apertures 56, and into dye presentation grooves 68. The operator combs the hair with bristles 74 to uniformly and controllably apply the dye from the grooves 68 to the air. The operator releases and compresses the bellows 76, as described above, to refill grooves 68 as needed. Applicator 90 can also be positioned in any orientation during the dyeing process due to this valving system.

Figure 14:
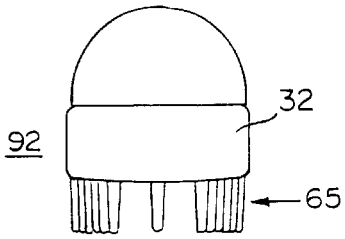
FIGS. 12–14 are front, side, and end views, respectively, of another embodiment of a hair dye applicator in accordance with the present invention.
Figure 12:
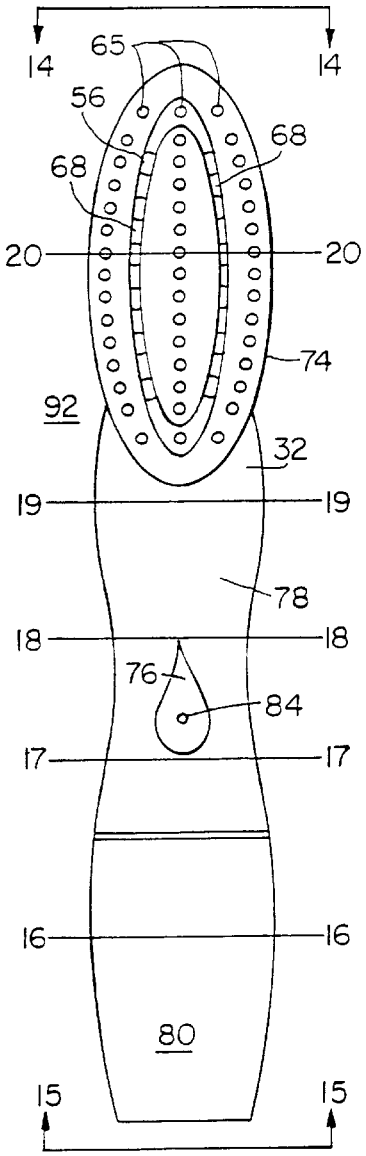
Figure 13:
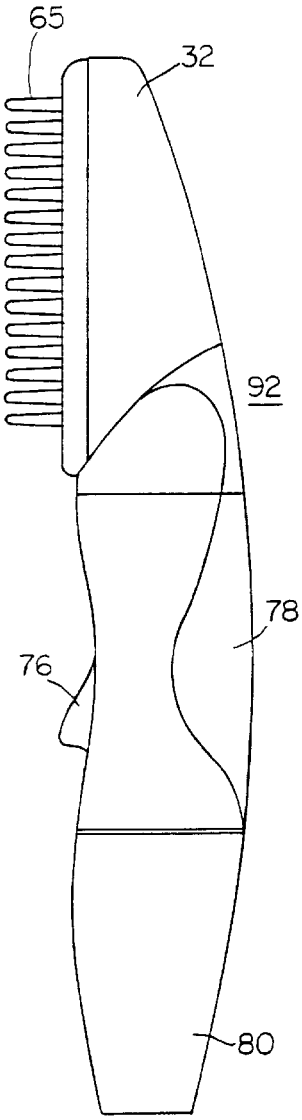
Figure 20:
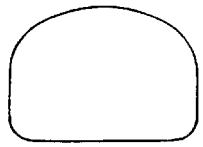
FIGS. 15–20 illustrate outer shapes of the hair dye applicator of FIGS. 12–14 taken from lines 15—15 through 20—20, respectively, of FIG. 12.
Figure 19:
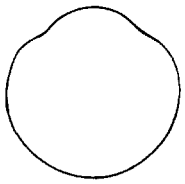
Figure 18:
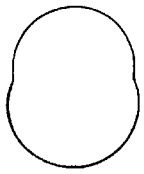
Figure 17:
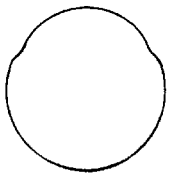
Figure 16:
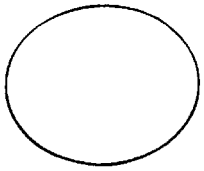
Figure 15:
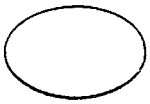

FIGS. 12–14 illustrate another preferred embodiment of an ergonomic applicator 92 employing bellows 76 to pump the liquid dye from the fluid container 22 to the operator's hair. Dye presentation grooves 68 are curved as shown similar to applicator 90. Brush cover 32 includes three rows of bristles 65 extending therefrom used by the operator to comb the hair during the dyeing process. FIGS. 15–20 illustrate outer shapes of the hair dye applicator 92 of FIGS. 12–15 taken from lines 15—15 through 20—20, respectively, of FIG. 12.

Figure 21:
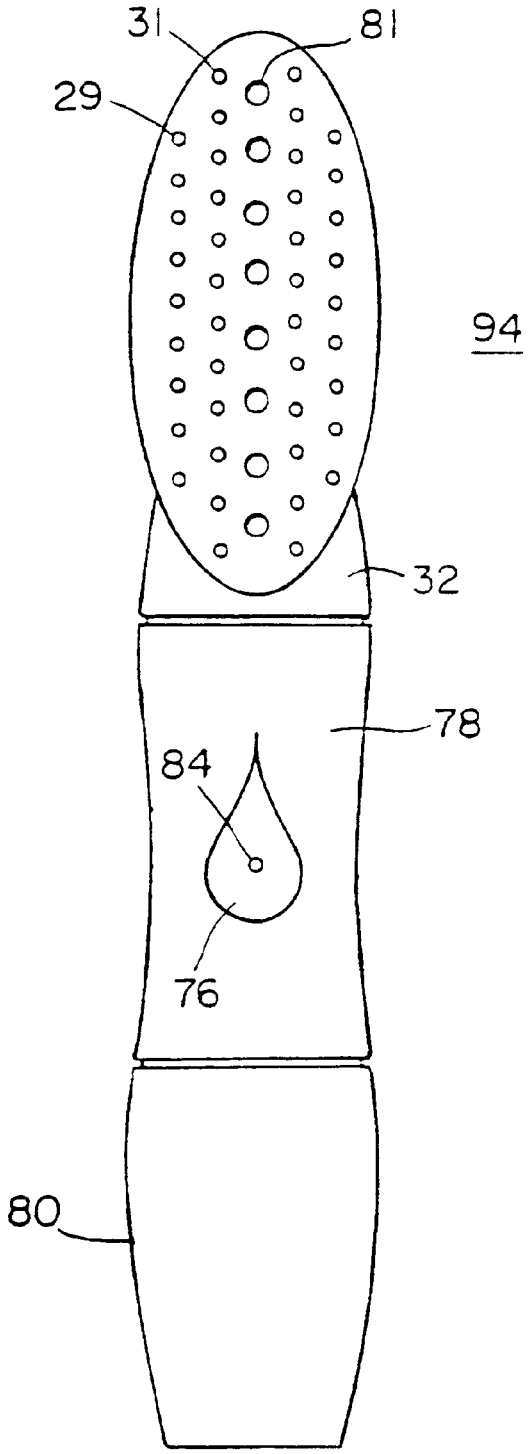
FIG. 21 is a front view of another embodiment of a hair dye applicator according to this invention particularly illustrating a brush cover used for streaking.
Figure 25:
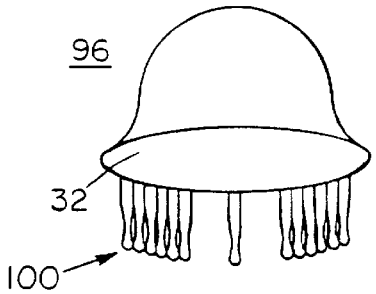
Figure 22:
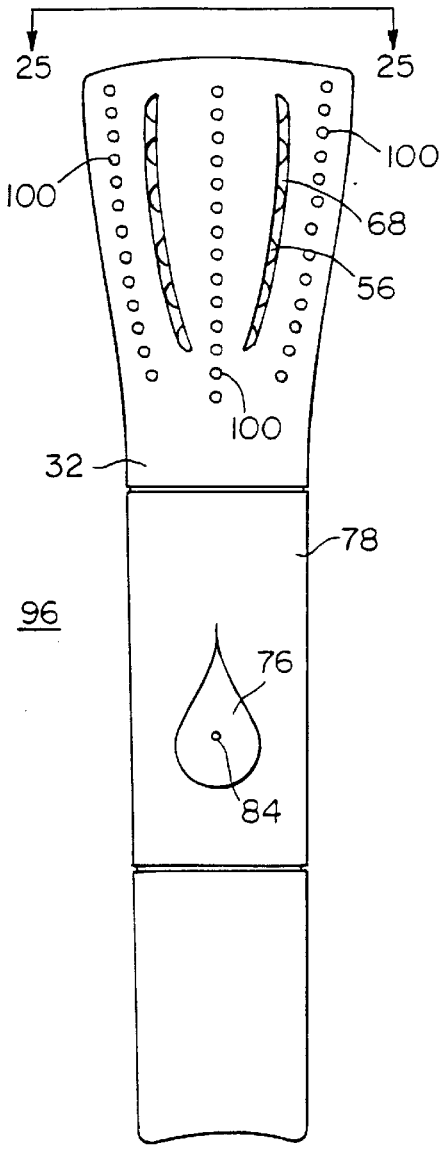
Figure 23:
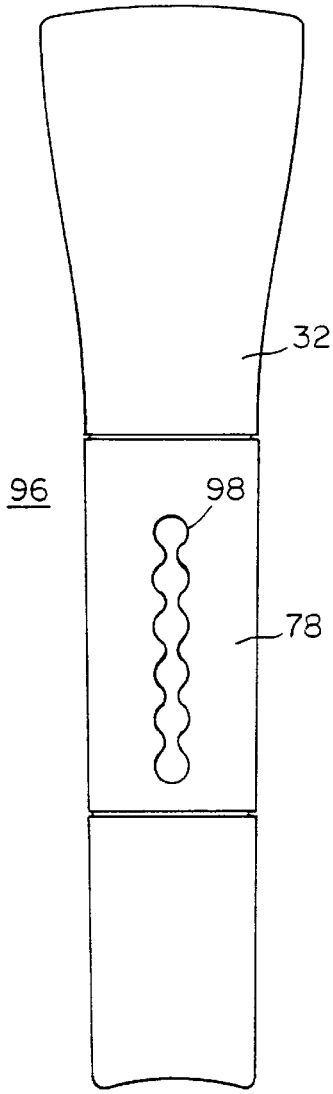

FIG. 21 illustrates another preferred embodiment of an ergonomic applicator 94 wherein the brush cover 32 includes a plurality of ports 81 in fluid communication with the liquid dye during the dyeing process. Ports 81 are spaced apart and are not joined by dye presentation grooves 68 as described above. This facilitates the dye being placed in lines or "streaks," as referred to in the art, as the hair is brushed through bristles 29 and 31. More specifically, the dye in ports 81 contacts the portion of hair combed by bristles 29 and 31 adjacent the ports resulting in the streaking effect.

FIGS. 22–25 illustrate another preferred embodiment of an ergonomic applicator 96 employing bellows 76 to pump the liquid dye from the fluid container 22 to the operator's hair. In this embodiment, jacket 78 includes an opening 98 to allow the operator to visually determine the amount of liquid dye in the fluid container 22. Brush cover 32, having bristles 100 extending therefrom, is wider at the top as particularly illustrated in FIGS. 22 and 23.

FIGS. 26–28 illustrate yet another preferred embodiment of an applicator 102 in accordance with the present invention. In this embodiment, the air container is surrounded by a rigid jacket 106 to prevent the air container from being compressed. Accordingly, jacket 106 can be formed from a variety of materials and preferably it is formed from a stiff ABS thermoplastic.

Jacket 106 includes an opening in which resilient bellows 108 is positioned. Another opening or aperture is provided in the air container such that bellows 108 communicates with the fluid container therein. An orifice can be provided in bellows 108, similar to orifice 84 described above, to replenish the air in bellows 108 after compression by the operator. Alternatively, a one-way valve can be provided in air container 12 for allowing air into the container 12 as the bellows 108 returns to its original position.

FIGS. 29–44 illustrate another preferred embodiment of a hair dye applicator 110 in accordance with the present invention. In this embodiment, an optional jacket 112 encases at least a portion of the compressible air container 114. The collapsible fluid container 116, which contains a liquid dye, is removably positioned within the air container 114 and includes an open end 118 for allowing egress of the liquid dye. In this embodiment, a one-way valve 120, such as a duckbill-type valve, is disposed at the open end 118 of the fluid container 116 for allowing one-way egress of the liquid dye from the fluid container.

Figure 29:
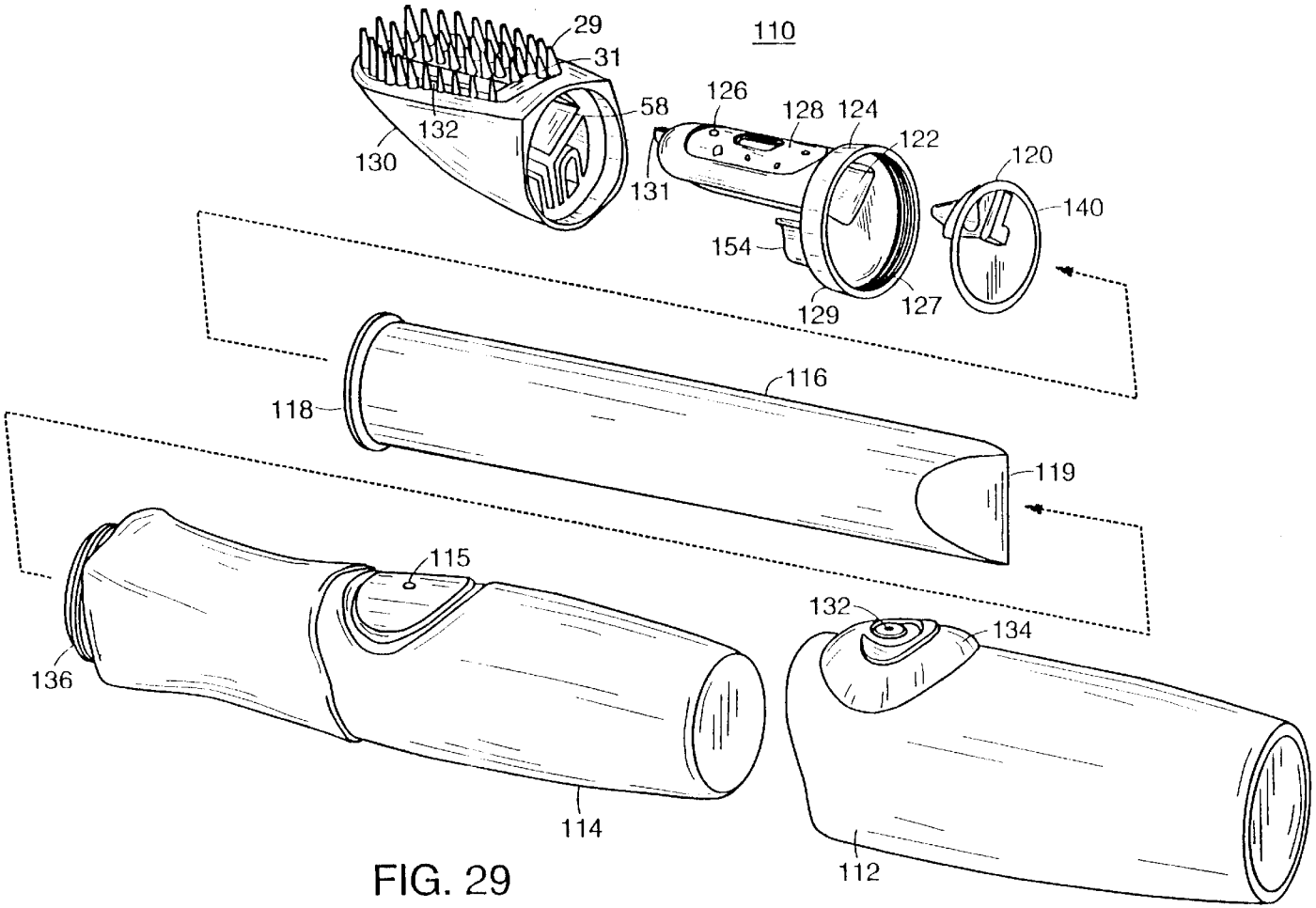
FIG. 29 is an exploded, isometric view of another hair dye applicator in accordance with the present invention.
Figure 30:
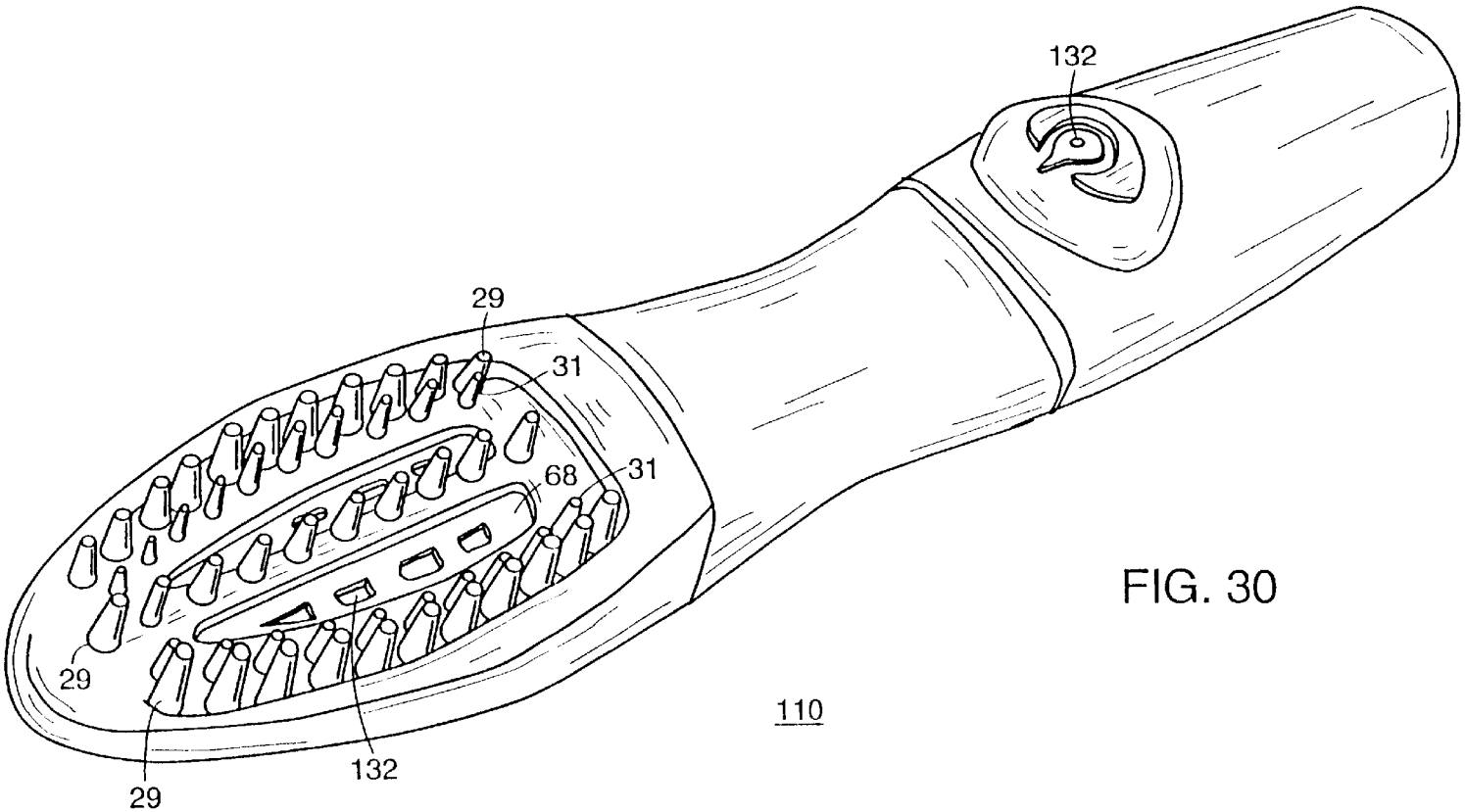
FIG. 30 is a perspective view of the assembled hair dye applicator of FIG. 29.

Preferably, the valve 120 mates within an internal conduit 122 of the manifold 124, as seen in FIG. 29. The internal conduit 122 communicates with orifices 126 of the manifold 124. The orifices 126 allow the liquid dye to flow to an outside surface 128 of the manifold 124. A brush cover 130 is removably positioned over the manifold 124 an includes apertures 132, such as seen in FIG. 30, there through for allowing the liquid dye to pass from the outside surface 128 of the manifold 124 to the hair to be dyed.

In this embodiment, air container 114 includes an aperture 115 there through which is covered by the user's finger as the air container is compressed. This serves to compress the collapsible fluid container 116 with the air in the air container 114 to force the liquid dye through the valve 120. As the user releases compressive force on the air container 114 with the finger not covering the aperture 115, the air container returns to its original configuration and fills with air. Preferably, the air container 114 is formed from a resilient material for returning to its original configuration. Simultaneously, the valve 120 substantially prevents the liquid dye or air from reentering the fluid container 116, therein the fluid container 116 reduces in volume. The user then squeezes the air container 114 again with a finger cover aperture 115 to further collapse the fluid container 116. The aperture 115 acts as a valving system to add air in the space between the collapsible fluid container 116 and the air container 114. This process is repeated during the dyeing process.

Figure 31:
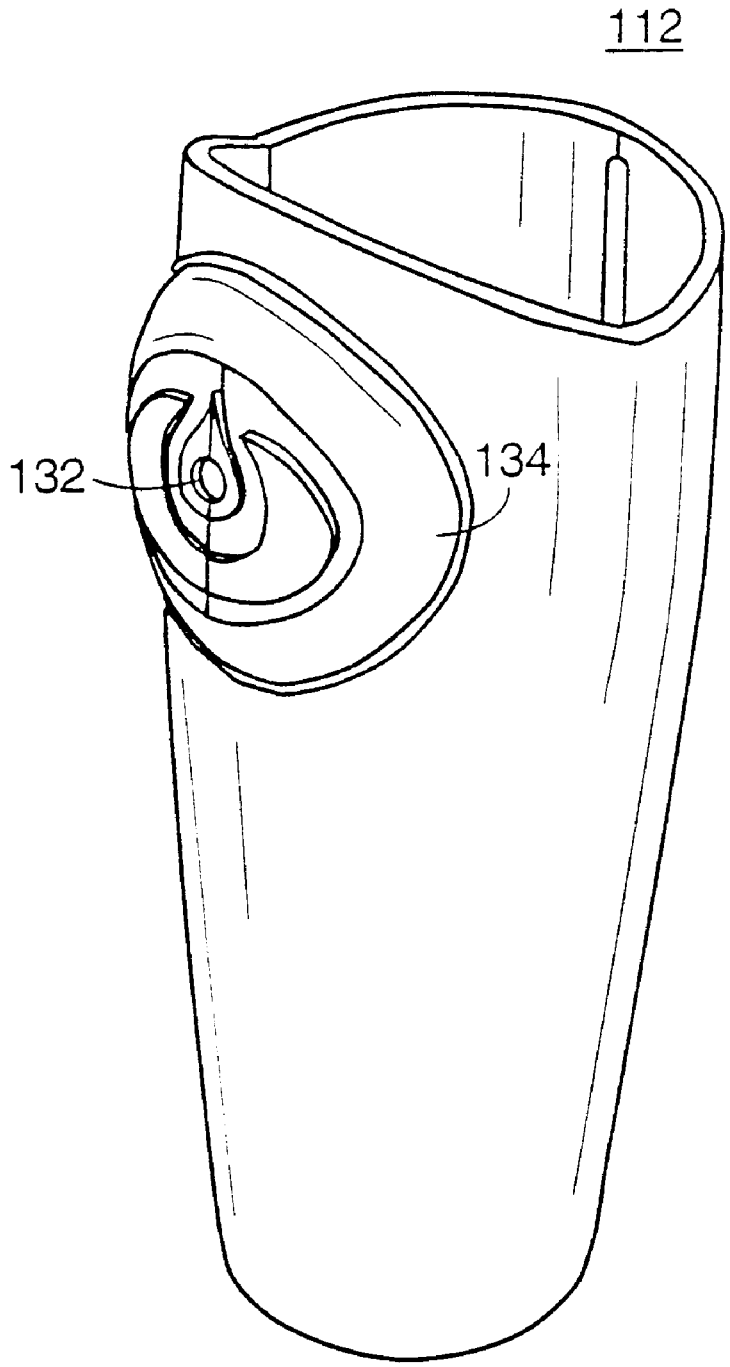
FIG. 31 is an enlarged perspective view of an optional jacket which encases the air container of FIG. 29.

FIG. 31 illustrates the jacket 112 which includes an aperture 133 that communicates with the aperture 115 of the air container 114. The jacket 112 is formed from a flexible material so as to be easily compressible. The aperture 133 is preferably formed in a bellows 134 integrally formed in the side of the jacket 112. Beneficially, this allows communications between apertures 133 and 115, even when the jacket 112 is not optimally aligned on the air container 114.

Figure 34:
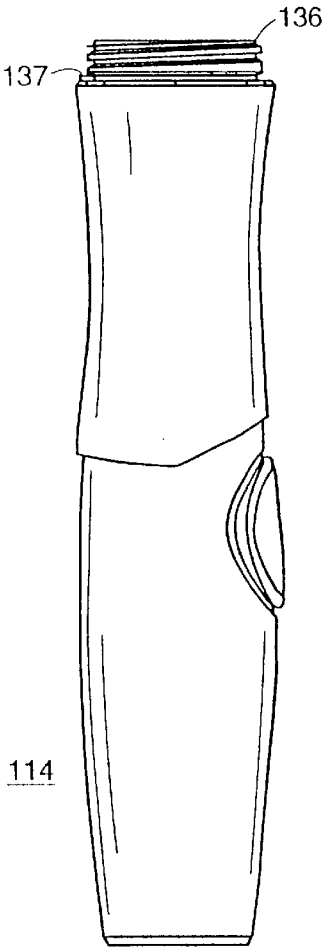
FIGS. 33 and 34 are front and side views, respectively, of the air container of FIG. 32.
Figure 33:
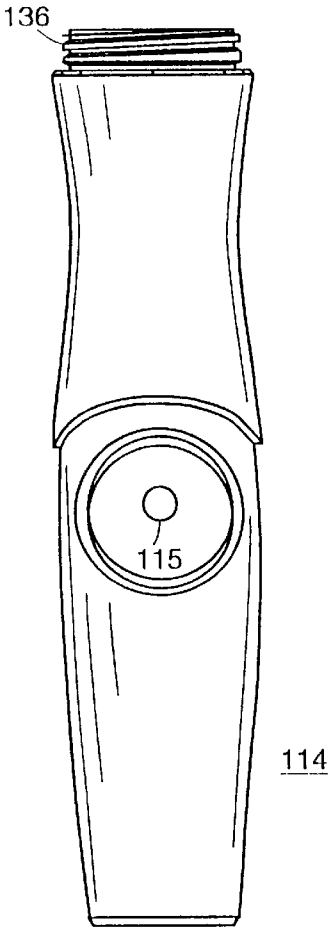
Figure 32:
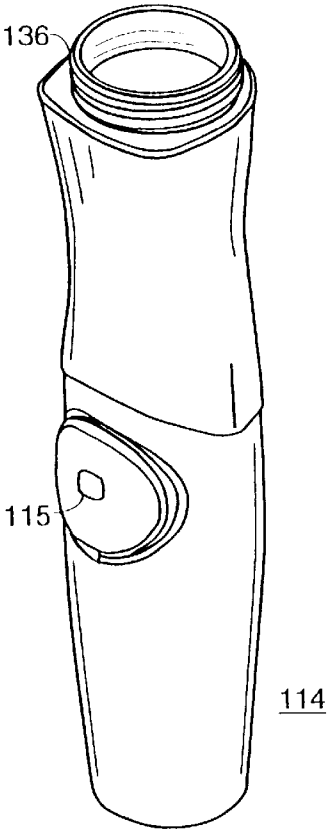
FIG. 32 is an enlarged perspective view of the air container of FIG. 29.

FIGS. 32–34 illustrate the air container 114 which includes external threads 136 which threadedly engage internal threads 127 of the manifold 124, as seen in FIG. 29, to removably secure the manifold on the air container. The hair dye applicator of the present invention can also include an alignment mechanism to align the manifold 124 onto the air container 114 in a predetermined orientation. The alignment mechanism can also prevent over-tightening of the manifold 114 onto the air container 114. In one embodiment, a protruding member 137 extends from the air container 114, as specifically seen in FIG. 34. Member 137 contacts a protruding member 125 of the manifold 124 (see FIGS. 38–40) when the manifold is oriented in the predetermined orientation.

Figure 35:
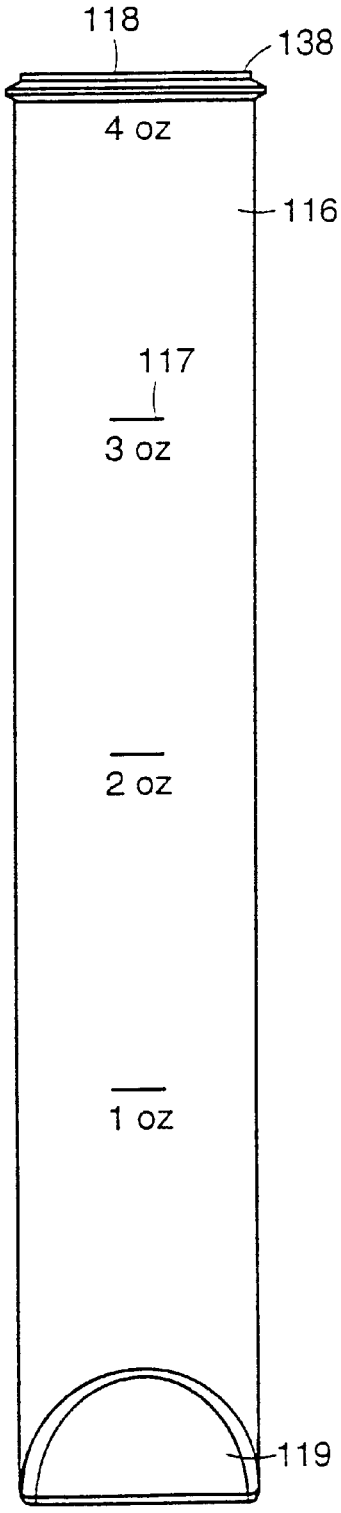
FIG. 35 is an enlarged plan view of the fluid container of FIG. 29.

FIG. 35 is an enlarged view of the fluid container 116. In one embodiment, the fluid container 116 includes a lip 138 at the open end 118 which forms a seal with the bottom 140 of the valve 120 when assembled. Preferably, the air container 114 and the fluid container 116 are transparent to allow the user to visually inspect the amount of liquid dye remaining in the fluid container. The fluid container 116 can contain marks 117 or other indicia which indicate the amount of liquid dye therein when initially filling. In one embodiment, the fluid container 116 includes a V-shaped end 119 which facilitates the collapse of the fluid container.

Figure 36:
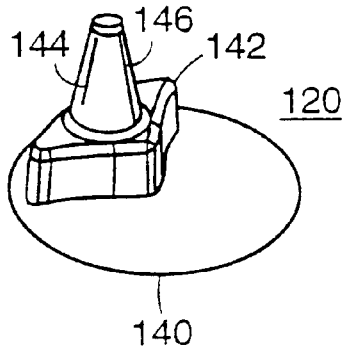
FIG. 36 is an isometric enlarged view of the duckbill valve of FIG. 29.
Figure 37:
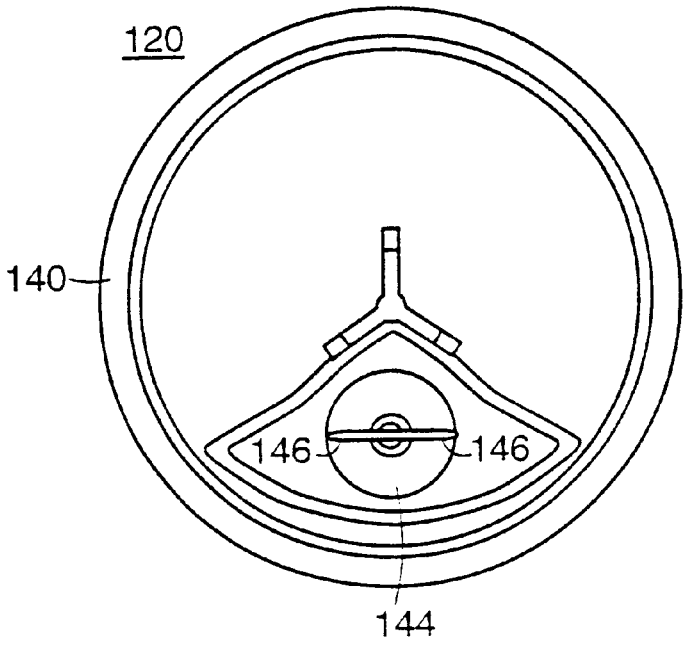
FIG. 37 is a bottom view of the duckbill valve of FIG. 36.

FIGS. 36 and 37 further illustrate the one-way valve 120 in accordance with the present invention. The valve 120 includes a raised portion 142 which supports the cone-shaped duckbill 144. The raised portion 142 preferably conforms to the shape of the conduit 122 of the manifold 124 to align the valve 120 thereto. The duckbill 144, in one embodiment, includes two slits 146 which allow the liquid dye to pass there through upon compression of the air container 114. The duckbill 144 is preferably formed from a flexible, resilient material such that the slits 146 will substantially close to prevent the liquid dye from reentering the fluid container 114 when the user stops compressing the air container 114.

Figure 38:
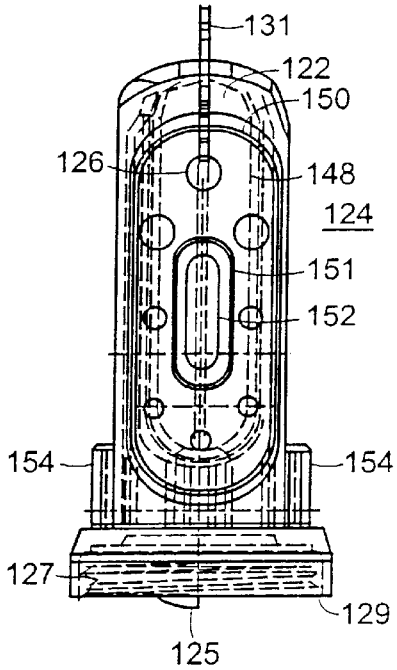
FIGS. 38–40 are front, isometric, and side views, respectively, of the manifold of FIG. 29.
Figure 39:
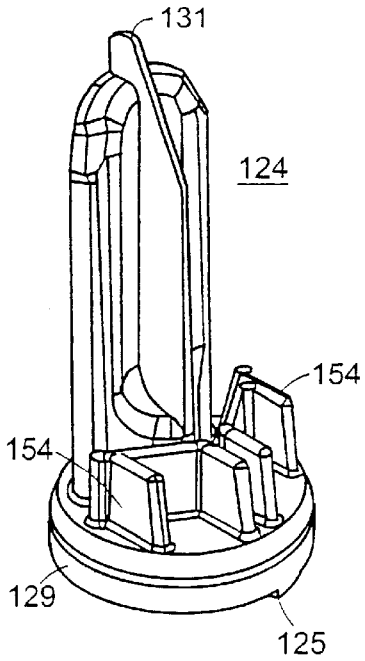
Figure 40:
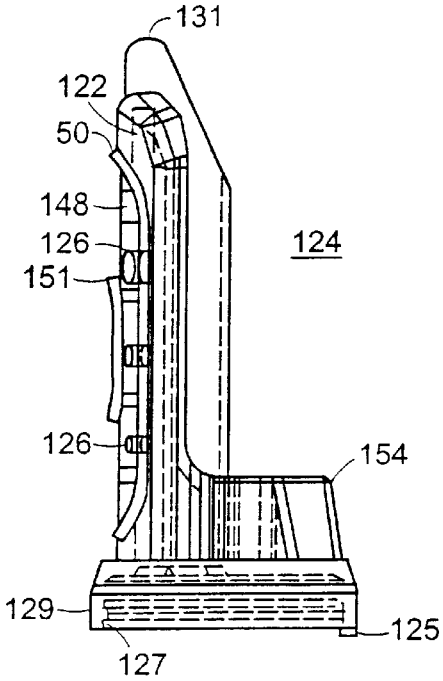
Figure 41:
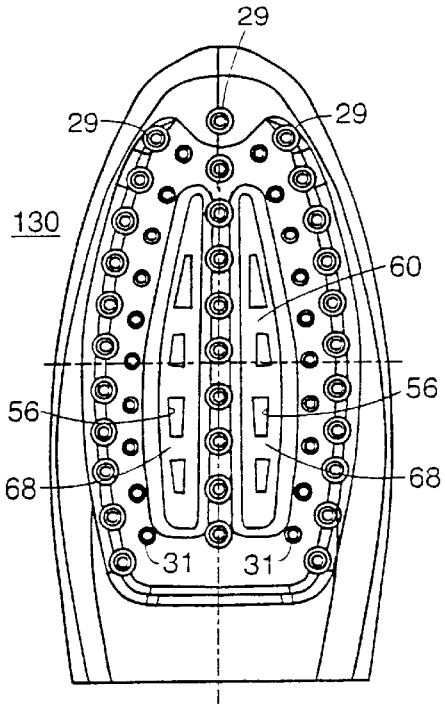
FIGS. 41–44 are front, isometric, end, and side views, respectively, of the brush cover of FIG. 29.
Figure 42:
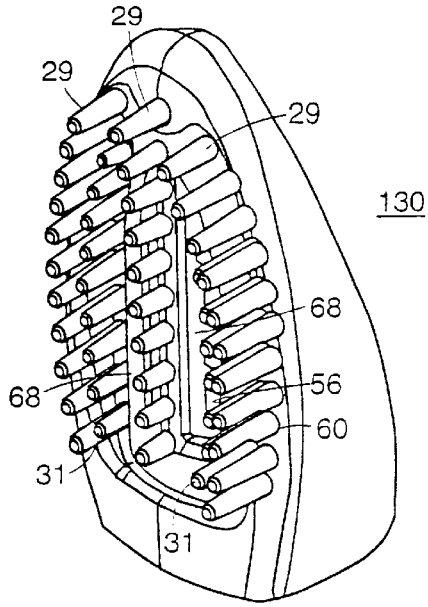
Figure 43:
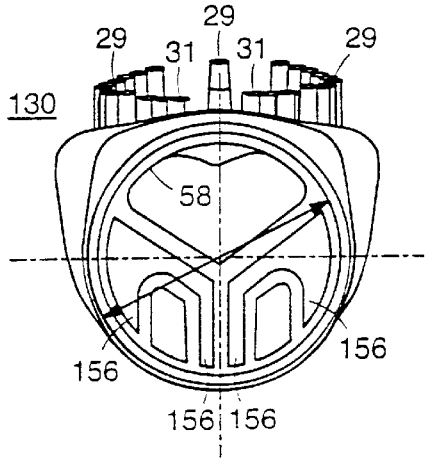
Figure 44:
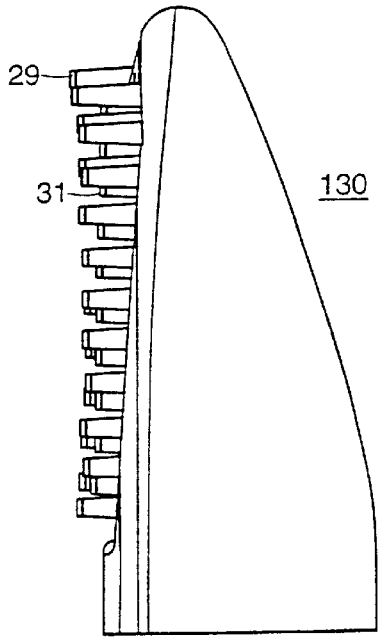

FIGS. 38–40 further illustrate the manifold 124 which includes a plurality of orifices 126 communicating the conduit 122 with an outside surface 148 of the manifold. The conduit 122, which includes an inlet at a first end 129, runs substantially the length of the manifold 124 along the longitudinal axis. The conduit 122 and the internal threads 127 of the manifold 124 are shown in hidden line in FIGS. 38 and 40. In one embodiment, the orifices 126 increase in diameter as a function of the distance from the first end 129. That is, the orifice(s) furthest from the first end 129 is the largest while the orifice(s) closest to the first end is the smallest for uniformly distributing the liquid dye along the outer surface 148 of the manifold 124.

A raised lip 150 snugly fits, upon assembly, to the inside surface 58 of the brush cover 130 to contain the liquid dye with the lip. In one embodiment, the manifold 124 can include a relatively large orifice 152 for allowing substantial amounts of liquid dye there through. A second raised lip 151 can surround orifice 152. An alignment mechanism is further provided to align the brush cover on the manifold 124. In one embodiment, the alignment mechanism includes extending members 154 of the manifold 124 which insert into pockets 156 of the brush cover 130 to align the brush cover thereon. In a preferred embodiment, the manifold 124 includes a projection 131 to support the "tip" of the brush cover 132.

FIGS. 41–44 illustrate the brush cover 132 which includes bristles or teeth 29, 31. As in other embodiments, apertures 56 pass through the cover 132 to an inside surface 58 and allow the liquid dye to pass to the outside surface 60 of the cover during the dyeing process. Dye presentation grooves 68 communicate with apertures 56 and are preferably positioned along a longitudinal axis of the cover 130 to allow the dye exiting apertures 56 to flow along the grooves to uniformly present the dye to the hair. In this embodiment, the cover 130 removably slides over the manifold 124 and is held thereon by a friction fit.

Figure 47:
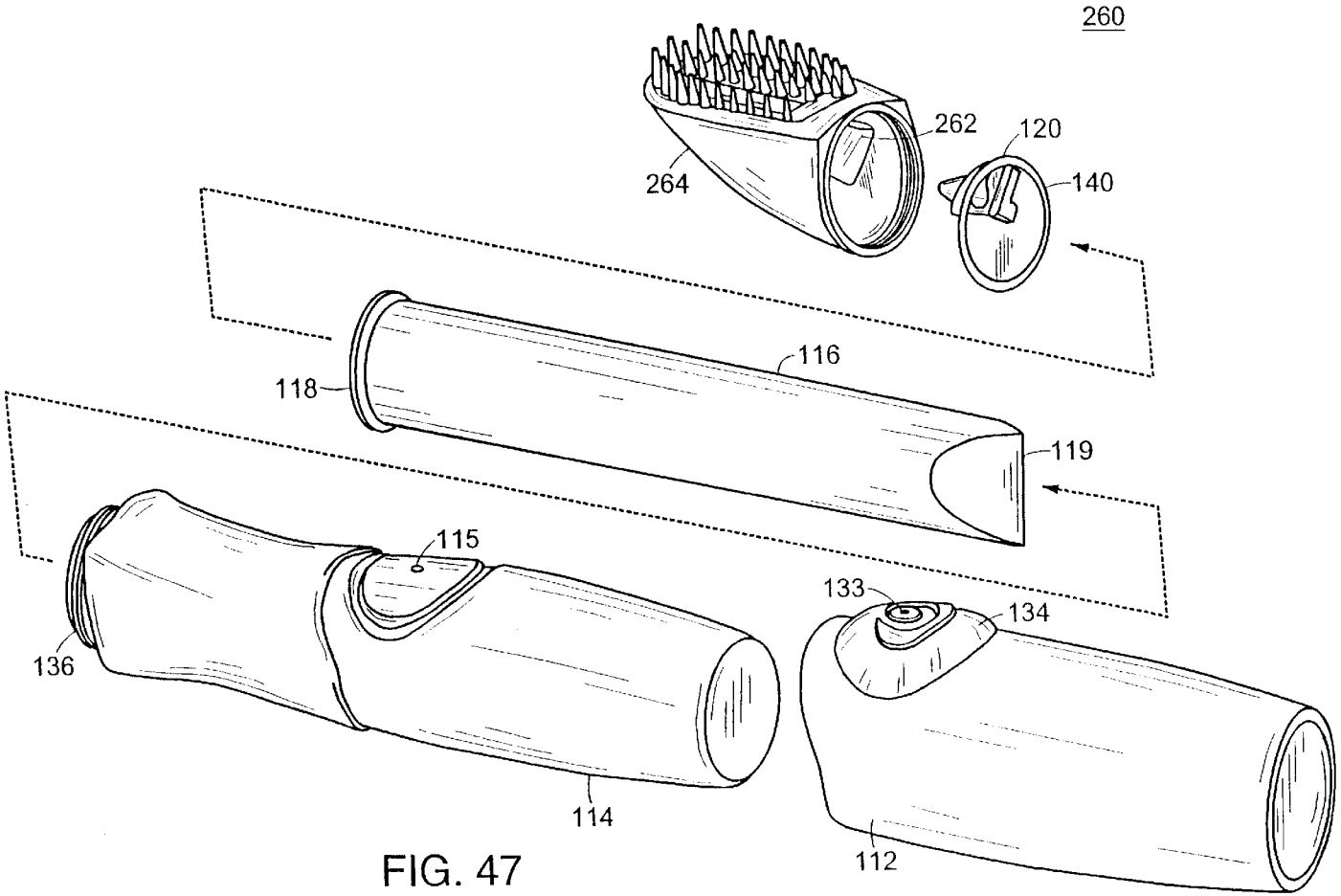
FIG. 47 is an exploded, isometric view of another hair dye applicator.

In an alternative embodiment, the manifold and the brush cover can be combined together to form a one-part unit, such as shown in FIG. 47. The combined unit functions similar to the two-part construction while being more economical to manufacture.

In operation of this embodiment, the user inserts the fluid container 116 into the air container 114. The desired amount of liquid dye is placed into the open end 118 of fluid container 116. The one-way valve 120 is seated onto the manifold 124 and the manifold is screwed onto the air container 114 until respective protruding members 125, 137 contact to align the manifold on the air container. The brush cover 130 is positioned over the manifold 124. Optional jacket 112 can be positioned over the air container 114.

The user compresses the air container 114 with a finger covering the apertures 115, 132 to collapse the fluid container 116 to force the liquid dye through one-way valve 120. The liquid dye passes through the orifices 126 of the manifold 124 and through apertures 56 to dye presentation grooves 68. As the user releases compressive force on the air container 114 with the finger not covering apertures 115, 132, the air container returns to its original configuration and refills with air through the apertures. Simultaneously, the one-way valve 120 substantially prevents the liquid dye from reentering the fluid container 116. This process is repeated to controllably present liquid dye to the hair being treated.

It is understood that applicators of any of the embodiments described above, such as applicator 96 of FIGS. 26–28, can also be used for other hair treatment or care purposes, such as the controlled dispensing of conditioner and shampoo.

Figure 45:
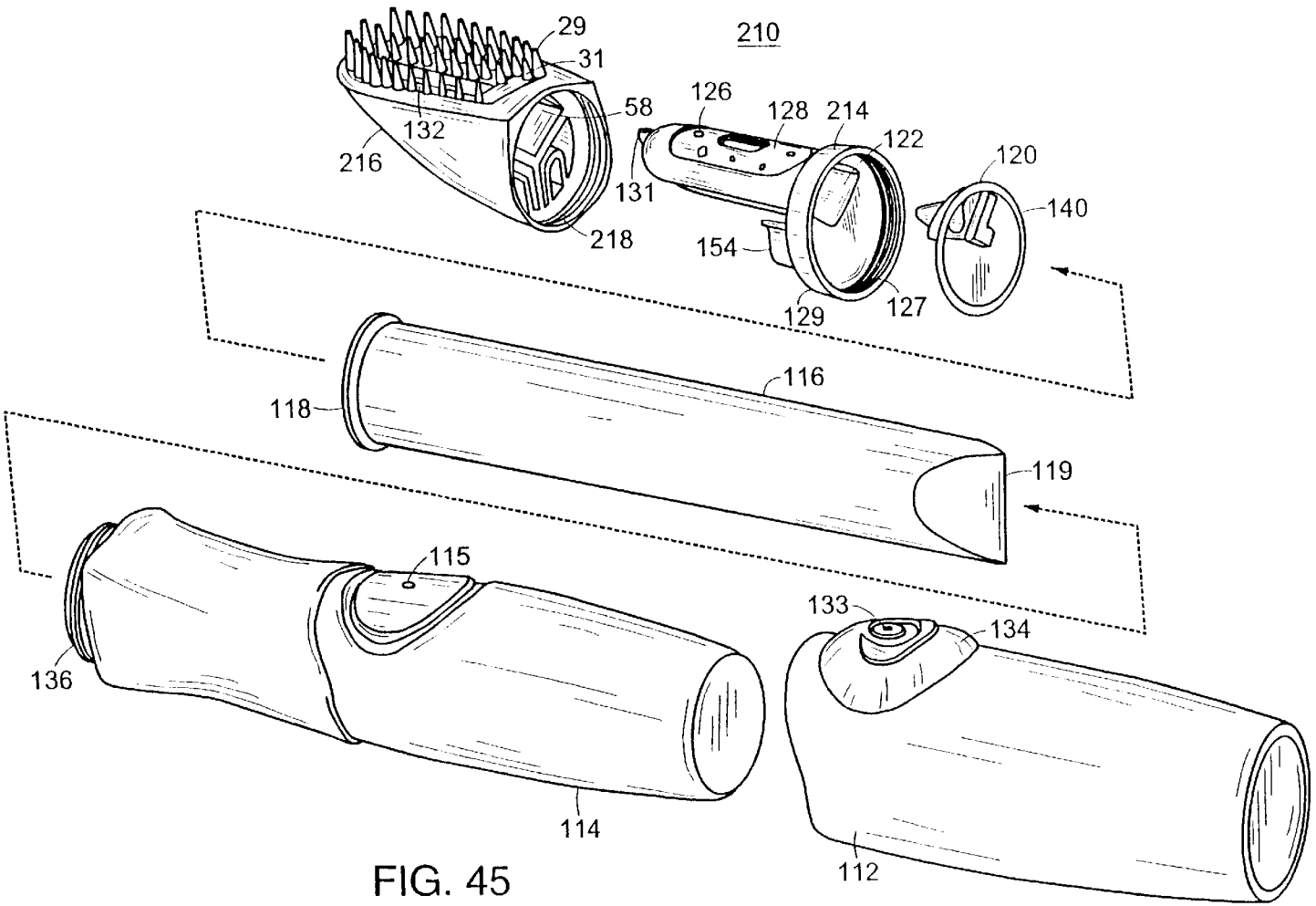
FIG. 45 is an exploded, isometric view of another hair dye applicator.

Referring to FIG. 45, an alternative embodiment of a hair dye applicator 210, similar to the hair dye applicator 110 of FIGS. 29–44, is shown with an optional jacket 112 encasing at least a portion of the compressible air container 114. The collapsible fluid container 116, which contains a liquid dye, is removably positioned within the air container 114 and includes an open end 118 for allowing egress of the liquid dye. A one-way valve 120, such as a duckbill-type valve, is disposed at the open end 118 of the fluid container 116 for allowing one-way egress of the liquid dye from the fluid container.

Preferably, the valve 120 mates within an internal conduit 122 of a manifold 214, as seen in FIG. 45. The internal conduit 122 communicates with a plurality of orifices 126 of the manifold 214. The orifices 126 allow the liquid dye to flow to an outside surface 128 of the manifold 214. A brush cover 216 is removably positioned over the manifold 214 and includes apertures 132, such as in previous embodiments, there through for allowing the liquid dye to pass from the outside surface 128 of the manifold 214 to the hair to be dyed.

The brush cover 216 has a ridge or lip 218 to create a friction fit to assist in retaining the manifold 214 in the brush cover 216.

Figure 46:
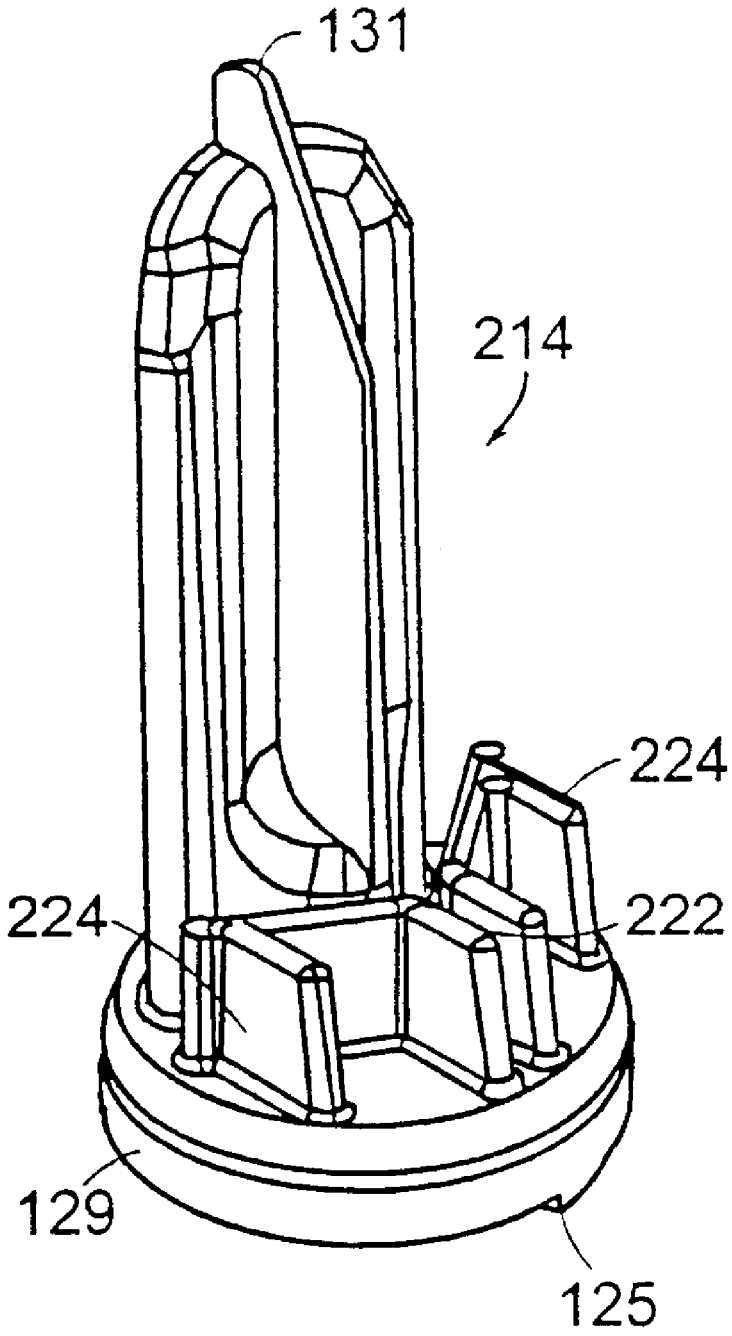
FIG. 46 is an isometric view of the manifold of FIG. 45.

It is recognized that other ridges or lips can be added to the hair dye applicator 210. For example, referring to FIG. 46, the manifold 214 has ridges 222 on the extending members 224. The optional jacket 112 and the compressible air container 114 can have ridges or lips to assist the friction fit.

Referring to FIG. 47, an alternative embodiment of a hair dye applicator 260 similar to the hair dye applicator 110 of FIGS. 29–44 is shown. The hair dye applicator 260 has an optional jacket 112 which encases at least a portion of the compressible air container 114. The collapsible fluid container 116, which contains a liquid dye, is removably positioned within the air container 114 and includes an open end 118 for allowing egress of the liquid dye. In this embodiment, a one-way valve 120, such as a duckbill-type valve, is disposed at the open end 118 of the fluid container 116 for allowing one-way egress of the liquid dye from the fluid container.

Preferably, the valve 120 mates within an internal conduit 262 of a brush/manifold unit 264. The internal conduit 262 communicates with apertures 264 which extend to the outside of the brush/manifold unit 264 and allow the liquid dye to flow to an outside surface 268.

In contrast to the previous embodiments, the manifold and brush are formed as one unit, the brush/manifold unit 264. The apertures 264 extend directly from the internal conduit 262 to the outside surface of the brush/manifold unit 264. In one embodiment, there are twelve (12) or more apertures and the apertures have a smaller diameter or size than in the previous embodiments.

The brush/manifold unit 264 can have a coating on the entire outer surface or teeth region, such as flexible material such as a thermoplastic rubber (e.g., Santoprene® brand rubber marketed by Advanced Elastomer Systems, L. P.), to provide a comfortable feel to the user. In one embodiment, the brush/manifold unit 264 is formed of polypropylene with the coating of Santoprene® applied to the brush/manifold unit 264 in an over-molding or insert molding process.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A hair dye applicator device, comprising:

a collapsible fluid container for containing a liquid dye, the fluid container having an open end for allowing egress of the liquid dye;

a one-way valve in communication with the open end of the fluid container for allowing egress of the liquid dye; and a compressible air container encasing the fluid container, the air container having an open end for receiving the fluid container, the air container also having an aperture there through;

wherein as the air container is compressed by a user, the fluid container collapses to force the liquid dye out of the fluid container.

* * * * *